United States Patent [19]

Dunning et al.

[11] 4,352,578

[45] Oct. 5, 1982

[54] PAPERBOARD RIBBON CARTRIDGE

[75] Inventors: Norman D. Dunning, Harrodsburg; Franklin D. Jervis, Lexington; Kenneth W. Taylor, Georgetown, all of Ky.

[73] Assignee: International Business Machines Corporation, Armonk, N.Y.

[21] Appl. No.: 185,105

[22] Filed: Sep. 8, 1980

[51] Int. Cl.[3] ..... B41J 35/28

[52] U.S. Cl. ..... 400/208; 229/16 R; 242/55.53; 400/207

[58] Field of Search ..... 400/207, 208; 206/387, 206/391, 393, 395, 396, 405, 406, 485, 491, 492; 242/55.53, 199, 200; 229/15, 16 R, 16 A, 17 S

[56] References Cited

U.S. PATENT DOCUMENTS

| | | | |
|---|---|---|---|
| 1,901,532 | 3/1933 | Powell et al. | 206/395 X |
| 1,927,667 | 9/1933 | Miller | 242/55.53 |
| 2,017,176 | 10/1935 | Andrews | 206/395 X |
| 2,257,208 | 9/1941 | Wagner | 242/55.53 |
| 2,293,187 | 8/1942 | Becker | 206/395 X |
| 3,130,892 | 4/1964 | Krueger et al. | 229/16 R |
| 3,151,723 | 10/1964 | Wendt | 400/207 |
| 3,185,373 | 5/1965 | Margulies | 206/491 X |
| 3,627,118 | 12/1971 | Daggs | 242/55.53 |
| 3,731,781 | 5/1973 | Caudill et al. | 400/208 |
| 3,958,768 | 5/1976 | Fairbanks | 206/391 X |

*Primary Examiner*—Ernest T. Wright, Jr.
*Attorney, Agent, or Firm*—John A. Brady

[57] ABSTRACT

The object of the invention is to provide a ribbon cartridge which can be made from bendable material such as cardboard. The cartridge is folded around the ribbon 27 connected to supply spool 5 and take-up spool 23 from a blank having top panel 1 joined to bottom panel 35 by separated front panels 61. An extension 69 from top panel 1 is folded into the cartridge to form an internal post 19. The cartridge is glued together.

35 Claims, 6 Drawing Figures

PAPERBOARD RIBBON CARTRIDGE

TECHNICAL FIELD

This invention relates to a cartridge for a typewriter ribbon and the like. More specifically, this invention relates to the provision of a cartridge of paperboard or the like replacing previous cartridges of molded plastic, both of generally the same overall design.

The use of molded plastic presents disposal problems, as the material is not recycleable or usefully recoverable. Moreover, molded plastic is derived primarily from petroleum, an increasingly scarce and expensive resource.

Chipboard, cardboard and other such paperboard is biodegradable. The cost of the material forming a cartridge is presently much less for paperboard than for plastic. Paperboard is in relatively plentiful supply. Overall, use of paperboard offers substantial cost reduction.

BACKGROUND ART

No prior teaching or use is known of a paperboard ribbon cartridge, as distinguished from a package for a single spool. The overall cartridge configuration achieved in the preferred embodiment is essentially identical with the prior art, as illustrated by the teaching of U.S. Pat. No. 3,731,781 to Caudill et al. Of course, various packages, holders, boxes and the like are formed from folded paperboard, but none forming a ribbon cartridge or the like adapted to become a functioning part of a typewriter is known. U.S. Pat. No. 2,257,208 to Wagner does disclose a package for a single spool of ribbon which permits the ribbon to unwind and be rewound within the package.

DISCLOSURE OF THE INVENTION

In accordance with the present invention, a cartridge is provided from bendable material having top and bottom panels held together by connected bendable side panels. Two panels at the front are separated. Aligned hole pairs journal the hub of a supply spool and the hub of a take-up spool. As in the predecessor cartridge, cut away portions at the front leave an area where the ribbon fits around the typing mechanisms. A cut away slot in the bottom panel permits a drive roller to move with the outer layer of ribbon in the roll.

One side panel is extended and bendable so that it forms one side of the cartridge and extends into the cartridge. In the cartridge it is bent again to form an internal post between the top and bottom panels. In the preferred embodiment it extends further to surround the hole in the top panel provided for the take-up spool hub, which provides added stiffening.

The cartridge is folded around the ribbon spools from a blank having scored areas for folding. It is glued together. This provides the desired finished cartridge made from paperboard.

BRIEF DESCRIPTION OF DRAWING

The details of this invention will be described in connection with the accompanying drawing, in which.

BEST MODE FOR CARRYING OUT THE INVENTION

Figure 1:
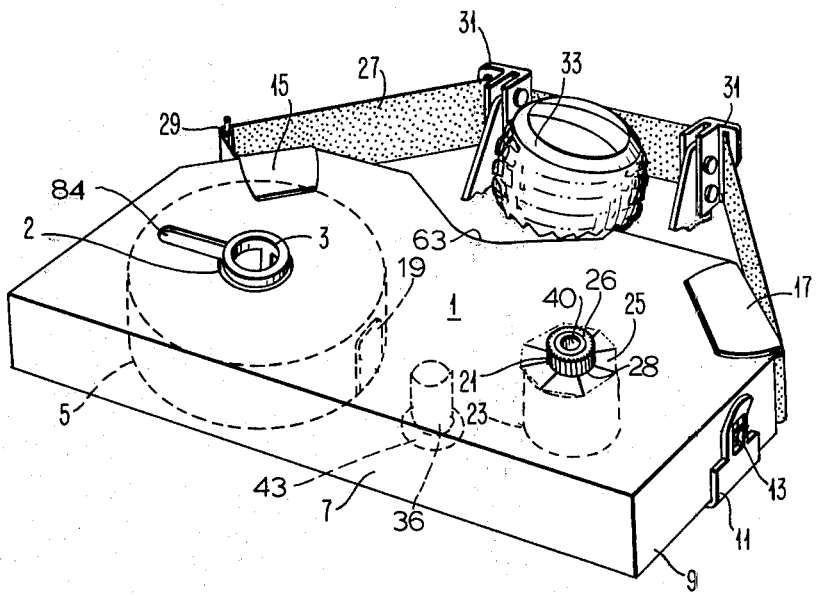
FIG. 1 is a perspective view of a finished cartridge mounted, showing closely associated structure of the typewriter.

FIG. 1 shows the preferred cartridge mounted with selected elements of typewriter structure to illustrate the intended use of the cartridge. The cartridge is folded and glued from a chipboard blank as will be described. The chipboard is high quality, stiff material, specifically 18 point solid bleached sulphate board. It is clay coated on one side to take printing and varnished at selected points on the inside as will be described.

FIG. 1 shows the cartridge from the top with top panel 1 having hole 2 which journals the hub 3 of typewriter ribbon supply spool 5. FIG. 1 also illustrates rear side panel 7, folded up from the bottom panel 35 as will be described. Right side panel 9, also folded up from the bottom panel 35, also appears in FIG. 1. Side panel 9 is contiguous to ear 11, in which a narrow resilient element 13 fits (also illustrated in FIG. 6).

Ear 11 and resilient element 13 are mounted on the base plate 90 of the existing typewriter and are not part of the novel aspects of this invention. Selected elements of the existing typewriter with which this invention is used will be described briefly in connection with FIG. 6.

FIG. 1 shows the attachment tab 15 of the exit ribbon guide panel 57 and the attachment tab 17 of the entrance ribbon guide panel 53, both also folded up from the bottom panel 35. Shown in dotted outline in FIG. 1, as it is hidden under top panel 1, is internal post 19, formed from the extended side panel 69 as will be described. The hub 21 of take-up spool 23 is journaled in top panel 1 in the right half. A circular grouping of bendable panels 25, made by cuts directed toward the center defined by panels 25, surrounds hub 21. The panels 25 are pushed aside with insertion of the end 26 of hub 21 and then return by inherent resilience to closely surround a smaller internal shaft 28 of hub 21 under end 26.

Typewriter ribbon 27 exits the cartridge from the left front, being guided by the left edge of the exit ribbon guide panel 57 which will be described. Ribbon 27 is positioned around spring guide 29, an element of the existing typewriter and through ribbon lift guides 31, which position ribbon 27 for inpact printing by single element printing head 33. Ribbon 27 enters the cartridge at the right of the entrance ribbon guide panel 53 which will be described and extends directly to take-up spool 23.

Figure 2:
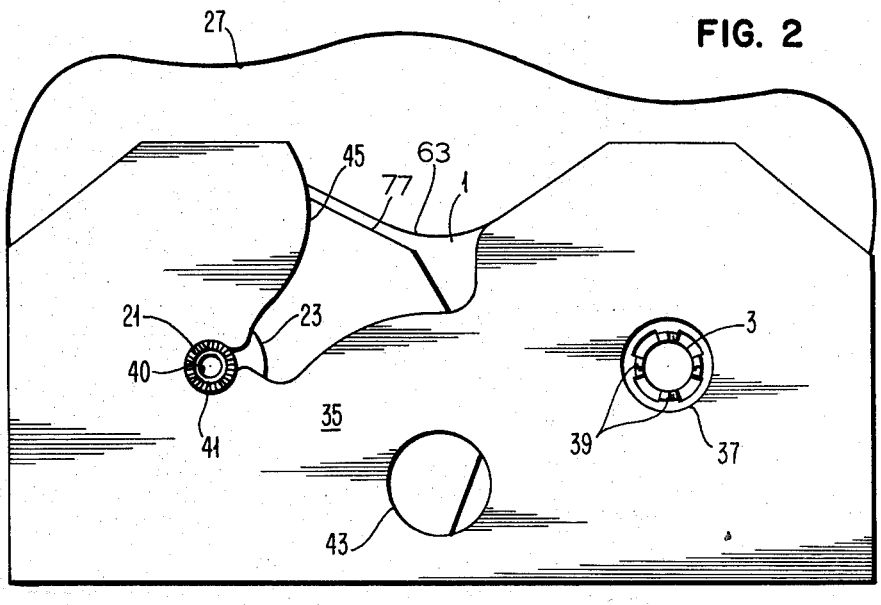
FIG. 2 is a bottom plan view of a finished cartridge.

The cartridge alone is shown directly from the bottom in FIG. 2. Ribbon 27 is shown limp but positioned generally at the points where it exits and enters the cartridge. The bottom panel 35 has a hole 37 to journal hub 3 of supply spool 5. Hole 2 of the top panel 1 is aligned with hole 37 of bottom panel 35 to receive hub 3 of supply spool 5 and hold it journaled for winding movement. FIG. 2 reveals an end view of splines 39, which extend along the length of hub 3, with the interior of hub 3 otherwise empty. Similarly hub 21 is seen to have a central opening 40.

Similarly, in bottom panel 35 is a smaller hole 41 which receives the hub 21 to take-up spool 23. Circular panels 25 of top panel 1 are aligned with hole 41 of bottom panel 35 to receive hub 21 and hold it journaled for winding movement. The hole 43 in bottom panel 35 permits a mechanism 36 (FIG. 1, shown symbolically) of the typewriter to enter, which entry is mechanically translated into control of the type of ribbon feed movement required for the ribbon in the cartridge. Lastly, the bottom panel 35 has a large, generally arcuate slot 45 leading from the front of the cartridge to the hub 21 of the take-up spool 23. This permits a drive roller 98 (FIG. 6) of the typewriter to ride against the outside of the take-up spool 23 as it increases in size during ribbon feed.

The slot 45, the ribbon feed sense hole 43, as well as the configuration of hubs 3 and 21, are not part of the novel aspects of this invention. Essentially identical parts and elements appear in the prior, molded-plastic cartridge.

Also with respect to FIG. 2, a portion of the top panel 1, can be seen as well as part of support panel 77, which will be fully described in connection with FIGS. 3 and 4.

Figure 3:
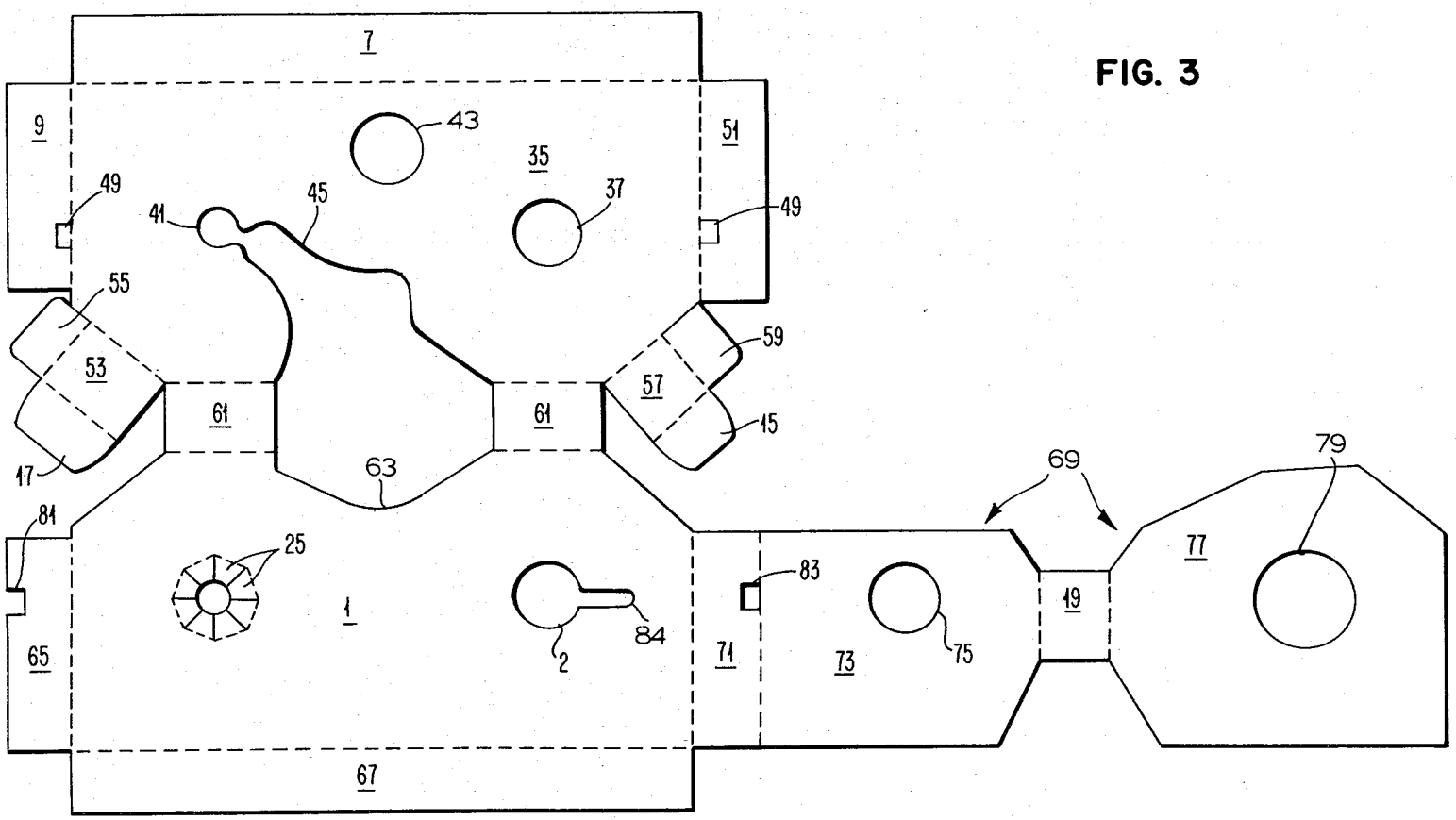
FIG. 3 shows the paperboard blank which is folded and glued into the cartridge.

The blank from which the cartridge is folded is shown, essentially to scale, in FIG. 3. Bendable lines, weakened as is conventional scoring created by pressed indentions, are indicated in FIG. 3 by dashed lines. The blank is die cut and scored conventionally.

As shown in FIG. 3, side panel 9 which is bendably connected to bottom panel 35, has a rectangular tab 49 fully cut out on three sides away from the cartridge and scored to be bendably attached along the line at which panel 9 is connected to bottom panel 35. On the opposite side an identical tab 49 is cut from the opposite side panel 51, which is the left side panel as the cartridge is viewed in FIG. 1. The tab 49 in panel 51 is also fully cut out on three sides and bendably connected on the fourth.

Entrance ribbon guide panel 53 is bendably connected on a straight line to bottom panel 35. Attachment panel 17 is bendably connected to the opposite side while reinforcement panel 55 is bendably connected to the side near side panel 9. In the final construction reinforcement panel 55 is bent completely over to be internal in the cartridge and is glued flat against panel 53. This strengthens the cartridge where ribbon 27 rides against it during entry.

Similarly, exit ribbon guide panel 57 is bendably connected on a straight line to bottom panel 35. Attachment panel 15 is bendably connected to the opposite side while reinforcement panel 59 is bendably connected to the side near side panel 51. In the final construction reinforcement panel 59 is bent completely over to be internal in the cartridge and is glued flat against panel 57. This strengthens the cartridge where ribbon 27 rides against it during exit.

Two front panels 61 are bendably connected along parallel lines to both the top panel 1 and the bottom panel 35. The panels 61 are spaced apart, leaving a relatively wide central area to which arcuate slot 45 connects and having an inwardly cut portion 63 in top panel 1. The space provided by the inwardly cut portion 63 and slot 45 provides space for the typewriter printing mechanisms to operate and is essentially identical in this respect to the configuration of the prior, molded-plastic cartridge.

The top panel 1 has a side panel 65 and a rear side panel 67, both bendably connected along straight lines to the right side (as viewed in FIG. 1) and rear, respectively, of panel 1. The front panels 61 and all of the side panels 7, 9, 51, 65 and 67 and the guide panels 53 and 57 are of same width in the direction extending away from their line of attachment to the top panel 1 or bottom panel 35. Thus, when the cartridge is folded, the top panel 1 and the bottom panel 35 are mounted in generally spaced, parallel planes.

On the right in FIG. 3 is the extended side panel 69. This has a first panel 71 bendably connected to a longer second panel 73, having a hole 75. Post 19 is bendably connected to panel 73 on a line. Finally, bendably connected to the opposite side of post 19 is reinforcement panel 77, having hole 79. Reinforcement panel 77 is of dimension to cover almost all of the area of the side of top panel 1 beginning at about the center of the cartridge.

On the outer side of side panel 65 is a cut-out rectangle 81 opposite which in panel 71 is an identical cut-out rectangle 83. In the finished cartridge cut-out rectangle 81 aligns directly under the tab 49 in panel 9 and cut-out rectangle 83 aligns directly under tab 49 in panel 51. This is provided so that when the cartridge is mounted, resilient members 13 on the typewriter push in the tabs 49 and enter the cartridge slightly to hold the cartridge in place.

Folding and gluing of the cartridge into complete form will now be described. For quantity production, equipment can be designed to achieve the folding automatically.

Generally, areas of the blank which will be the internal surface in the finished cartridge have a conventional, varnish finish. Where a surface is to be glued to another surface, neither have a varnish finish. The varnish finish simply facilitates winding movement of ribbon 27 within the cartridge and provides a barrier against inks and other materials from ribbon 27 soaking into the cartridge. For convenience in manufacture, the entire inside face of bottom panel 35 has a varnish finish even though part of that face will be screened from the inside of ribbon 27 by panel 73. The side of post 19 which faces hole 2 has a varnish finish. The side of reinforcement panel 77 shown in FIG. 3 is glued to panel 1 as will be described and does not have a varnish finish, but the opposite side does. The area in top panel 1 covered by panel 77 does not have a varnish finish, but the remainder of panel 1 does. All of the inside faces of side panels 61, 65, 67 and 71 also have varnish finish. Panels 55 and 59 have no varnish, while panels 53 and 57 are unvarnished where panels 55 and 59 respectively, after being folded are glued on them and are varnished over the remainder of their inside area.

Figure 4:
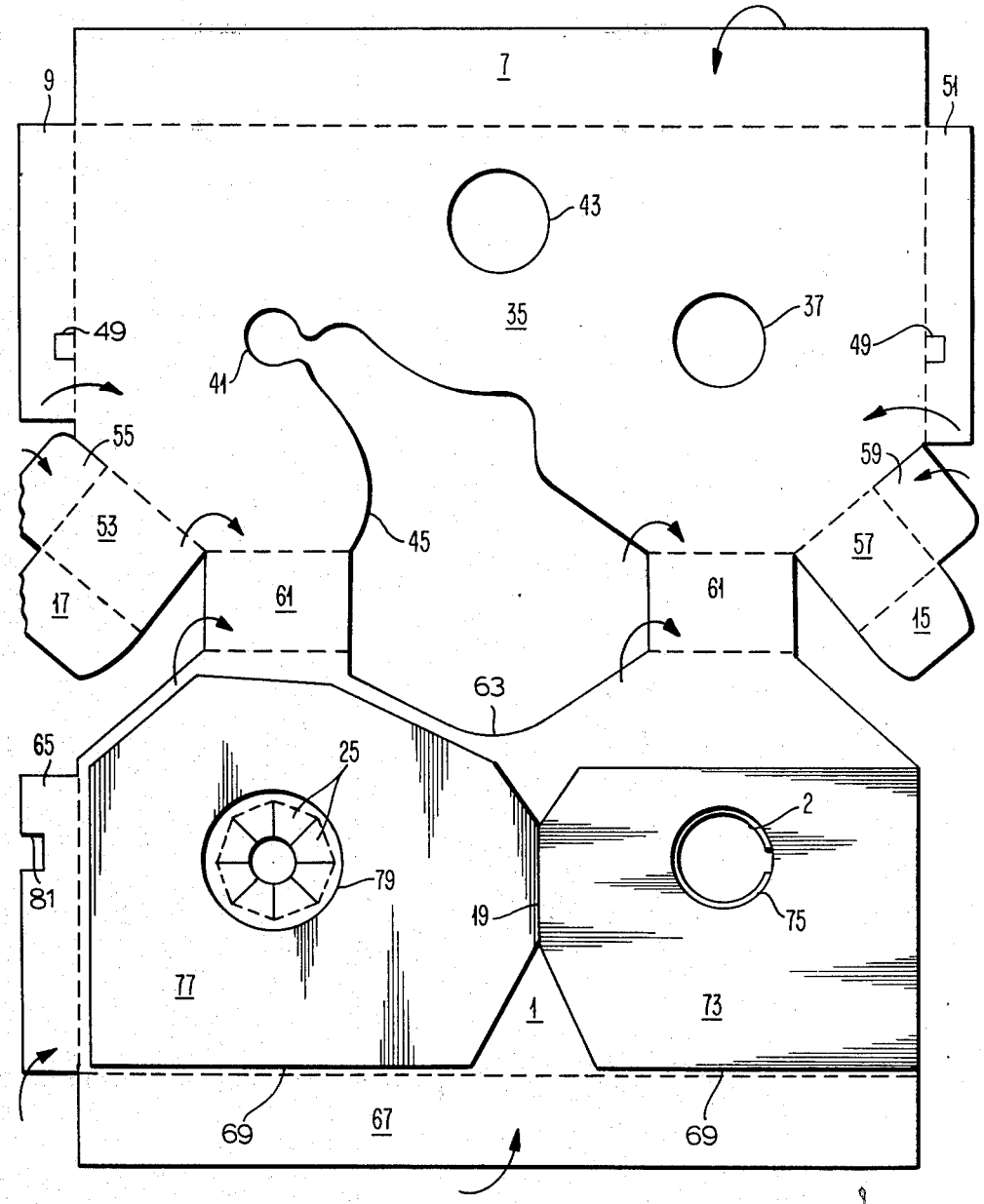
FIG. 4 shows the blank partially folded so as to illustrate the folding operation.

For clarity, FIG. 4 illustrates the folding operation without showing ribbon 27 and associated spools 5 and 23. It will be clear, of course, that in fact the blank is folded around the spools 5 and 23, with a length of ribbon 27 extending out between exit panel 57 and entrance panel 53 and with hub 3 journaled in holes 2 and 37 and hub 21 journaled in hole 41 and in the hole formed by panels 25.

FIG. 4 shows the extended side panel 69 folded to its final position in the cartridge. In this position panel 77 is glued to top panel 1 all along its outer periphery and also all around the periphery of hole 79.

The glue used is a standard cold adhesive used conventionally to hold folded paperboard. As with the folding operation, for quantity production equipment can be designed to position ribbon 27 and spools 5 and 23 and to apply the glue mechanically.

The panel 73 of extended side panel 69 in the completed cartridge will be in contact with bottom panel 35, but it is not glued to it. Hole 75 is concentric and aligned with hole 2. To complete the cartridge, panel 55 is folded toward the inside of the cartridge and glued against panel 53, panel 59 is folded toward the inside of the cartridge and glued against panel 57. Top panel 1 and bottom panel 35 are bent at their connection with panels 61 to be brought into spaced, parallel relationship. Side panels 65 and 67 are bent to right angles. Panel 9 is bent over panel 65 and glued to it. Panel 51 is bent over panel 71 (see FIG. 3) and glued to it, and rear panel 7 is bent over panel 67 and glued to it. Attachment tab panels 15 and 17 are bent to contact top panel 1 and are glued to it.

With these attachments made, the cartridge is complete. Although not shown in FIG. 4, it has been folded around and contains ribbon 27 and spools 5 and 23 as previously described and shown particularly in FIGS. 1 and 2.

Figure 5:
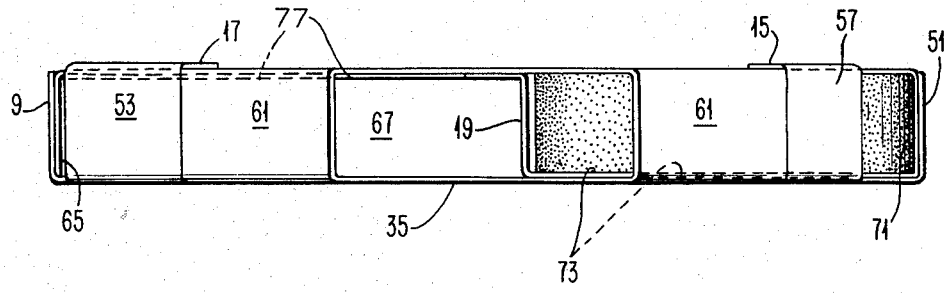
FIG. 5 shows a front elevation view of the completed blank with the internal spools deleted for clarity.

FIG. 5 is a front view of the cartridge, also shown without ribbon 27 and spools 5 and 23 for purposes of clarity. Individual layers of lamination are exagerated in FIG. 5 to further clarify the structure. As is clear from FIG. 5, the exit guide panel 57 is shorter than the entrance guide panel 53. That configuration is dictated by the structure of the typewriter for which the specific cartridge is intended and forms no part of this invention.

PURPOSE OF ELEMENTS OF THE COMPLETED CARTRIDGE

Ribbon 27 exits the cartridge in contact with the outside end of exit guide panel 57. To strengthen and assure a smooth surface at that point of contact, panel 59 has been bent over and glued against the inside of panel 57. Similarly, panel 55 has been glued against entrance guide panel 53 on the side where ribbon 27 rides as it enters the cartridge.

The enlarged end 26 at the top of take-up spool hub 21 is for manual turning and is identical to that in the prior cartridge. The long narrow slot 84 in hole 2 is for visual observation of the amount of ribbon 27 left on the supply spool 5. It is also identical to that in the prior cartridge.

The rectangular tabs 49 in the right and left sides replace molded indentation in the prior cartridge. The tabs 49 are free to move inward because one of the tabs 49 is backed by hole 81 in panel 65 and the other tab 49 is backed by hole 83 in panel 71. They cooperate with resilient position elements 13 as mentioned in connection with FIG. 1 and shown in FIG. 6 to permit elements 13 to move slightly within the cartridge to hold it when mounted.

Post 19 provides support to hold top panel 1 and bottom panel 35 off of the ribbon spools 5 and 23.

Panel 77 finds no counterpart in the prior ribbon cartridge. It was found necessary to add support to top panel 23 at the side journaling hub 21 of the take-up spool 23. The cartridge may be routinely removed from the typewriter and without panel 77 the circular panels 25 were found to at times be stretched enough so that the hub 21 came out of alignment with hole 41.

Figure 6:
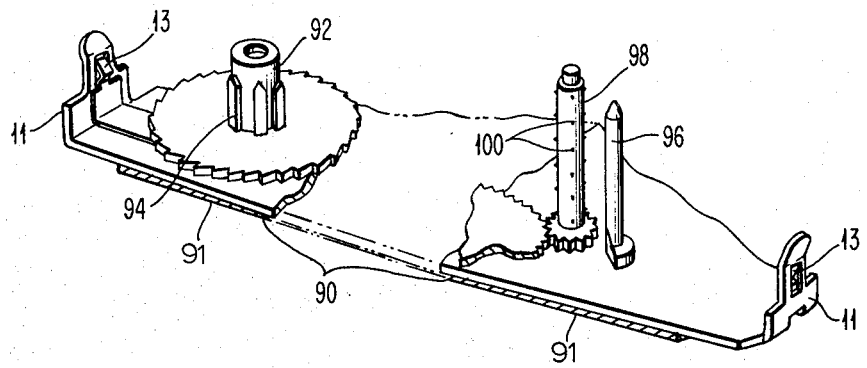
FIG. 6 PRIOR ART
FIG. 6 illustrates selected elements of the structure upon which the preferred cartridge is mounted when in use.

FIG. 6 shows elements of the typewriter closely associated with the cartridge. Everything shown in FIG. 6 is in the prior typewriter. The typewriter has a base plate 90 mounted on a carrier 91 (shown illustratively) which carries ribbon 27 with feed mechanism, as well as other structures. The carrier 91 moves across a line to effect printing. The base plate 90 journals a hollow shaft 92 having splines 94. Splines 94 intermesh with splines 39 in supply spool hub 3. Spaced from shaft 92 is spindle 96, which fits into the hollow center hole 40 of take-up hub 21. A drive roller 98, having drive projections 100 is mounted for arcuate movement to remain in contact with the outside of take-up spool 23 as it changes size. On each side of the elements are the ears 11, each having a resilient element 13 in their center opening.

The cartridge in accordance with this invention is mounted with splines 94 adapting an intermeshed position with splines 39 of hub 3. Resilient elements 13 push in tabs 49. In conjunction with ears 11 and base plate 90, the cartridge is then locked against all movement but vertical.

Typing is effected as with the prior cartridges.

It will be apparent that the true contribution and scope include major aspects of this cartridge design as well as specific form, which in certain respects noted in the foregoing has elements of form primarily to accommodate a present typewriter. Accordingly, the scope of coverage should not be limited by the preferred embodiment disclosed, but should be commensurate with the contribution herein described, with particular reference to the accompanying claims.

What is claimed is:

1. A blank of stiff, bendable material having:

a top panel having at least two holes for receiving a hub of a supply spool and a hub of a take-up spool, said holes being separated sufficiently to permit a ribbon wound on said supply spool to be wound on said take-up spool;

two separated front panels bendably connected to the front side of said top panel;

a bottom panel bendably connected to the sides of said front panels opposite to the sides connected to said top panel and having holes for receiving said hub of said supply spool and said hub of said take-up spool corresponding in position to the corresponding holes of said top panel, said top panel and said bottom panel being bendable to define first aligned holes and second aligned holes;

an extended side panel bendably connected to one of a group of panels consisting of said top panel and said bottom panel of a length to extend generally to the center of said top and bottom panels and bendable at said center to form a post separating said top panel and said bottom panel.

2. The blank as in claim 1 wherein said extended side panel has a bendable line to provide a side panel and a hole in the area between said bendable line and said post to receive the hub which is received by said first aligned holes.

3. The blank as in claim 2 also comprising two ribbon guide panels each bendably attached to one panel of said group of panels consisting of said top panel and said bottom panel, each on opposite sides of said front panels, formed to be bent over to form a guide for said ribbon moving between said spools and having a bendable line to provide an attachment tab formed to be glued to said panel of said group of panels opposite said one panel.

4. The blank as in claim 2 wherein said extended side panel has a part extending beyond the part forming said post and formed to generally surround a hole of said second aligned holes.

5. The blank as in claim 3 wherein said extended side panel has a part extending beyond the part forming said post and formed to generally surround a hole of said second aligned holes.

6. The blank as in claim 5 wherein said hole of said second aligned holes surrounded by said part extending is surrounded by a plurality of cuts directed toward the center of said hole surrounded by cuts so that said hole surrounded by cuts is yieldable to receive a head of a hub and to close by resilient return around a shaft smaller than said head.

7. The blank as in claim 4 wherein said extended side panel is bendably connected to said top panel and wherein said bottom panel also comprises a slot formed to permit a drive roller to ride against the outer layer of said ribbon as said ribbon is rolled on said take-up spool held in said second aligned holes.

8. The blank as in claim 5 wherein said extended side panel is bendably connected to said top panel and wherein said bottom panel also comprises a slot formed to permit a drive roller to ride against the outer layer of said ribbon as said ribbon is rolled on said take-up spool held in said second aligned holes.

9. The blank as in claim 8 wherein said hole of said second aligned holes surrounded by said part extending is surrounded by a plurality of cuts directed toward the center of said hole surrounded by cuts so that said hole surrounded by cuts is yieldable to receive a head of a hub and to close by resilient return around a shaft smaller than said head.

10. The blank as in claim 9 wherein blendably connected side panels are connected to the back and two sides of said bottom panel and to the back and the side opposite said extended side panel of said top panel, the side panels being formed to be bent at bendable points and glued to corresponding ones of said side panels to space said top panel from said bottom panel.

11. The blank as in claim 10 wherein the left and right of said side panels have cut out points formed to be entered by a resilient member on a typewriter to which a cartridge made from said blank as described is mounted.

12. A cartridge formed from a blank as described in claim 1 with a supply spool and a take-up spool inside and a ribbon extending out of the cartridge between said supply spool and said take-up spool, said blank being glued at side panels holding said top panel and said bottom panel in spaced relationship and at a part bendably connected to said post.

13. A cartridge formed from a blank as described in claim 2 with a supply spool and a take-up spool inside and a ribbon extending out of the cartridge between said supply spool and said take-up spool, said blank being glued at side panels holding said top panel and said bottom panel in spaced relationship and at a part bendably connected to said post.

14. A cartridge formed from a blank as described in claim 3 with a supply spool and a take-up spool inside and a ribbon extending out of the cartridge between said supply spool and said take-up spool, said blank being glued at side panels holding said top panel and said bottom panel in spaced relationship and at a part bendably connected to said post.

15. A cartridge formed from a blank as described in claim 4 with a supply spool and a take-up spool inside and a ribbon extending out of the cartridge between said supply spool and said take-up spool, said blank glued at side panels holding said top panel and said bottom panel in spaced relationship and generally all around said part surrounding said hole where said part surrounding said hole surrounds said hole.

16. A cartridge formed from a blank as described in claim 5 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

17. A cartridge formed from a blank as described in claim 6 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

18. A cartridge formed from a blank as described in claim 7 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

19. A cartridge formed from a blank as described in claim 8 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

20. A cartridge formed from a blank as described in claim 9 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

21. A cartridge formed from a blank as described in claim 10 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

22. A cartridge formed from a blank as described in claim 11 with a supply spool and a take-up spool inside and a ribbon extending out of the cartridge between said supply and said take-up spool, said blank being glued at side panels holding said top panel and said bottom panel in spaced relationship and generally all around said part surrounding said hole where said part surrounding said hole surrounds said hole.

23. A blank of stiff, bendable material having:

a top panel having at least two holes for receiving a hub of a supply spool and a hub of a take-up spool, said holes being separated sufficiently to permit a ribbon wound on said supply spool to be wound on said take-up spool;

two separated front panels bendably connected to the front side of said top panel;

a bottom panel bendably connected to the sides of said front panels opposite to the sides connected to said top panel and having holes for receiving said hub of said supply spool and said hub of said take-up spool corresponding in position to the corresponding holes of said top panel, said bottom panel also comprising a slot formed to permit a drive roller to ride against the outer layer of said ribbon a said ribbon is rolled on said take-up spool held between said top panel and said bottom panel in said holes; and bendably connected side panels connected to the back and two sides of said bottom panel and to the back and two sides of said top panel;

the side panels being formed to be bent at bendable points and glued to corresponding ones of said side panels to space said top panel from said bottom panel, the left and right of said side panels having cut out portions formed to be entered by a resilient member on a typewriter to which a cartridge made from said blank as described is mounted.

24. The blank as in claim 23 in which one of said side panels is an extended panel bendably connected to one panel of a group of panels consisting of said top panel and said bottom panel of a length to extend generally to the center of said top and bottom panels and bendable at said center to form a post separating said top panel and said bottom panel.

25. The blank as in claim 24 wherein said extended side panel has a part extending beyond the part forming said post and formed to generally surround one of said holes in said top panel.

26. The blank as in claim 25 wherein said one hole in said top panel is surrounded by plurality of cuts directed toward the center of said one hole so that said one hole is yieldable to receive a head of said hub of said take-up spool and to close by resilient return around a shaft smaller than said head.

27. A cartridge formed from a blank as described in claim 23 with a supply spool and a take-up spool inside and a ribbon extending out of the cartridge between said supply spool and said take-up spool, said blank being glued at side panels holding said top panel and said bottom panel in spaced relationship.

28. A cartridge formed from a blank as described in claim 24 with a supply spool and a take-up spool inside and a ribbon extending out of the cartridge between said supply spool and said take-up spool, said blank being glued at side panels holding said top panel and said bottom panel in spaced relationship and at a part bendably connected to said post.

29. A cartridge formed from a blank as described in claim 25 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

30. A cartridge formed from a blank as described in claim 26 with a supply spool and a take-up spool inside and a ribbon extending out of the cartridge between said supply spool and said take-up spool, said blank being glued at side panels holding said top panel and said bottom panel in spaced relationship and generally all around said part surrounding said hole where said part surrounding said hole surrounds said hole.

31. A cartridge containing a typewriter ribbon and formed from a flat blank comprising:

a first portion for forming the top of said cartridge, said first portion further defining a pair of apertures for rotatably receiving a take-up and supply spool, respectively;

second and third portions bendably attached to said first portion for forming the front of said cartridge;

a fourth portion attached to the side of said second and third portions opposite said first portion and bendable with respect to said second and third portions for forming the bottom of said cartridge, said fourth portion further comprising surfaces defining a plurality of apertures therein, two of said apertures positioned and sized, with respect to said apertures in said first portion to rotateably support said supply and take-up spools, respectively, a third aperture defined by said bottom portion to permit entry of a control part of a ribbon feed mechanism, and a fourth aperture, interconnecting with and extending out from said aperture for rotateably supporting said take-up spool, a plurality of portions attached at least to said first portion and bendable with respect thereto to form side walls of said cartridge, and means for joining said side walls to said fourth portion to complete said cartridge.

32. The cartridge as in claim 31 also comprising a side portion which is extended, said extended side portion being bendably connected to one portion of a group consisting of said first portion and said fourth portion and of a length to extend generally to the center of said cartridge and being attached to the inside of said cartridge to form a post.

33. The cartridge as in claim 32 wherein said extended side portion has a portion extending beyond said post and generally surrounding a hole supporting said take-up spool and being glued generally all around where said portion extending beyond the part forming said post surrounds said hole.

34. The cartridge as in claim 33 wherein said hole surrounded by said extending portion is surrounded by a plurality of cuts directed toward the center of the hole so that the hole is yieldable to receive a head of a hub and to close by resilient return around a shaft smaller than said head.

35. The cartridge as in claim 34 wherein said side walls comprise left walls and right walls and said left walls and said right walls have cut out points formed to be entered by a resilient member on a typewriter.

* * * * *